US006585031B2

(12) United States Patent
Takeya

(10) Patent No.: US 6,585,031 B2
(45) Date of Patent: Jul. 1, 2003

(54) METHOD OF INJECTION MOLDING A LOW-MELTING-POINT ALLOY

(75) Inventor: Kengo Takeya, Hiroshima (JP)

(73) Assignee: The Japan Steel Works, Ltd., Tokyo (JP)

( * ) Notice: Subject to any disclaimer, the term of this patent is extended or adjusted under 35 U.S.C. 154(b) by 0 days.

(21) Appl. No.: 10/072,914

(22) Filed: Feb. 12, 2002

(65) Prior Publication Data

US 2002/0124986 A1 Sep. 12, 2002

(30) Foreign Application Priority Data

Mar. 9, 2001 (JP) ..... 2001-066329

(51) Int. Cl.[7] ..... B22D 17/10; B29C 45/50

(52) U.S. Cl. ..... 164/457; 164/113; 164/133; 425/145; 264/40.1

(58) Field of Search ..... 164/457, 133, 164/113, 151.1; 425/145; 264/40.1

(56) References Cited

U.S. PATENT DOCUMENTS 5,785,110 A * 7/1998 Guergov ..... 164/113
5,792,395 A * 8/1998 Ito et al. ..... 264/40.1
6,325,954 B1 * 12/2001 Sasaki et al. ..... 264/40.1
6,365,075 B1 * 4/2002 Kamiguchi et al. ..... 264/40.3

FOREIGN PATENT DOCUMENTS

JP 2694587 B2 12/1993

* cited by examiner

*Primary Examiner*—M. Alexandra Elve
*Assistant Examiner*—Len Tran
(74) *Attorney, Agent, or Firm*—Sughrue Mion, PLLC

(57) ABSTRACT

In a control method of the injection molding in accordance with the invention, in the process of injecting molding a low-melting-point alloy, an upper limit $Q_{max}$ and a control lower limit $CQ_{min}$ of a quantity of material detained in a cylinder 12 are set to eliminate an excess or a shortage of the quantity of material detained in the cylinder 12. A material in a quantity greater than shot weight $Q_{out}$ is fed continuously into the cylinder until the upper limit is reached, while the material in a quantity less than the shot weight is fed into the cylinder until the lower limit is reached, thereby automatically maintaining the quantity of material detained in the cylinder within the range between the upper and lower limits. Accordingly, the down time due to the instability of metering in a molding machine can be reduced, and manpower for adjustment of conditions is not required, thereby making it possible to curtail the cost.

6 Claims, 8 Drawing Sheets

CHIP
CONFIGURATION
10mm
11
12
13
14
15
16
17
19

ROTATIONAL LOAD PRESSURE

SHOT WEIGHT: Qout
QUANTITY OF MATERIAL FED: Qin
: SHOT WEIGHT Qout
: QUANTITY OF MATERIAL FED Qin

QUANTITY OF MATERIAL DETAINED: Q
NUMBER OF SHOTS

: ROTATIONAL LOAD PRESSURE
: BACK PRESSURE
ROTATIONAL LOAD PRESSURE
BACK PRESSURE

SHOT WEIGHT: Qout
QUANTITY OF MATERIAL FED: Qin
: SHOT WEIGHT Qout
: QUANTITY OF MATERIAL FED Qin

QUANTITY OF MATERIAL DETAINED: Q
NUMBER OF SHOTS

METHOD OF INJECTION MOLDING A LOW-MELTING-POINT ALLOY

BACKGROUND OF INVENTION

1. Field of Invention

The present invention relates to a method of injection molding a low-melting-point alloy, and more particularly to a method of injection molding a low-melting-point alloy in which a low-melting-point alloy, which is a molding material, is melted in a cylinder of a screw-type low-melting-point alloy injection molding machine and is injected into a mold by a screw to effect molding, and control is provided such that an appropriate quantity of material is fed from a material feeder in correspondence with a shot and the quantity of material detained in the cylinder is maintained appropriately.

2. Related Art

Conventionally, methods of injection molding a low-melting-point alloy include a pressure die casting process and a metal injection molding process. The low melting point referred to herein means a temperature up to 700° C. or thereabouts, and as specific materials which can be used, Al, Mg, Zn, Bi, Sn, and Pb alloys correspond to them. As shown in FIG. 1*a*, a low-melting-point alloy injection molding machine using an in-line type screw as in the metal injection molding process is comprised of a screw-type, belt-type, or a vibration-type material feeder 16 for feeding material chips of a low-melting-point alloy, a screw 11, a cylinder 12, and a heater 13 for transporting and melting the fed material, a nozzle 14 and a high-speed injecting apparatus 17 for injecting and ejecting the molten material into a mold 19, and so on.

With the above-described low-melting-point alloy injection molding machine, a metal in chip form which is obtained by cutting ingots, as shown in FIG. 1*b*, is used as a raw material. In the low-melting-point alloy injection molding machine, the material stored in the hopper of the material feeder 16 is fed into the cylinder 12 by the material feeder 16. The material thus fed is transferred forwardly inside the cylinder 12 by the rotation of the screw 11 disposed in the cylinder 12 so as to be rotatable and reciprocatable. The material, while being transferred, is set in a predetermined molten state on heating by the heater 13 (an electric heater, a induction heater, or the like) attached to an outer peripheral portion of the cylinder 12.

At the time of the above-described heating, the screw 11, while rotating in the cylinder 12, retains the material in the molten state (a molten light metal) in a retaining section 15 at a distal end of the screw 11, and retracts to the material feeder side at a fixed speed. The material in the molten state retained in the retaining section 15 is metered by the amount of this retraction. Namely, at the point of time when the screw 11 reaches a predetermined retraction stroke as the screw 11 rotates, the rotating and reciprocating motion of the screw 11 are finished, thereby completing the metering of a predetermined quantity of a molten light metal corresponding to the retraction stroke. In the injection process after completion of the metering, the screw 11 is advanced at high speed by the high-speed injecting apparatus 17, and the molten light metal metered in the retaining section 15 is injected into the mold 19 through the nozzle 14 at the distal end of the cylinder 12.

With such a low-melting-point alloy injection molding machine, there are cases where, during the metering operation, the rotational load pressure of the screw rises, and the number of revolution of the screw varies. If such a situation occurs, variations occur in the quantity of molten metal injected in an ensuing shot. It is experientially known that the rise of the rotational load pressure is related to the quantity of material detained in the cylinder and occurs when the quantity of material detained exceeds an upper limit. That is, the quantity of material detained is determined by the relationship between, on the one hand, the quantity of material chips (quantity of material chips=$Q_{in}$) fed from the material feeder and, on the other hand, the quantity of molten metal discharged (shot weight=$Q_{out}$) discharged into the mold in the injection process for each shot. The following situation occurs depending on the relationship between their relative magnitudes:

(A) In the case of $Q_{in}>Q_{out}$:

Since the quantity of material fed is large relative to the shot weight, the quantity of material detained, Q, inside the cylinder increases by $$\Delta Q(=Q_{in}-Q_{out})$$

for each shot. Consequently, increments ΔQ of the detained quantity are accumulated with the advance of molding, and there are cases where an abnormality occurs to the rotation of the screw when the quantity of material detained, Q, has exceeded an upper limit $Q_{max}$.

(B) In the case of $Q_{in}<Q_{out}$:

Since the quantity of material fed is small relative to the quantity of molten metal discharged, the quantity of material detained, Q, decreases by $$\Delta Q(=Q_{out}-Q_{in})$$

for each shot. Consequently, decrements ΔQ of the detained quantity are accumulated with the advance of molding, and a short shot occurs when the quantity of material detained, Q, has fallen below a lower limit $Q_{min}$.

As described above, the quantity of material detained in the cylinder exerts a large influence on the stability of the metering of the low-melting-point alloy injection molding machine, so that, in practice, a balance is established between them, and adjustment of molding conditions is carried out so as to effect molding in a state in which a fixed quantity of material is detained. As a specific countermeasure, while observing the change in the rotational load pressure or the state of filling of molded articles, and the like, settings of the quantity of material fed, q, per unit time or the feeding time $t_s$ of the material feeder, and the like are adjusted on the basis of experience so as to feed the material in a quantity commensurate with the shot weight. However, it has been difficult to stably and continuously maintain the quantity of material detained due to the variation of the shot weight and the variation of the quantity of material fed by the material feeder, or due to a change in the molten state of the material in the cylinder in consequence of the temporary stopping of the machine.

SUMMARY OF INVENTION

The invention has been devised to overcome the above-described problems, and its object is to provide a method of injection molding a low-melting-point alloy in which an upper limit and a lower limit of the quantity of material detained in the cylinder are set to eliminate an excess or a shortage of the quantity of material detained in the cylinder in the process of injection molding a low-melting-point alloy, and which is capable of automatically maintaining the quantity of material detained in the cylinder within the range between the set upper and lower limits.

To overcome the above-described problems, in accordance with the invention there is provided a control method of an injection molding in which a low-melting-point alloy, which is a molding material, melted in a cylinder of a screw-type low-melting-point alloy injection molding machine and injected into a mold by a screw to effect molding, and control is provided such that an appropriate quantity of material is fed from a material feeder in correspondence with a shot and the quantity of material detained in the cylinder is maintained appropriately, comprising the steps of:

setting a unit increment ($\Delta Q^+$) and a unit decrement ($\Delta Q^-$) as well as an upper limit ($Q_{max}$) and a control lower limit ($CQ_{min}$) of a quantity of material detained; and automatically repeating the operation in which an injection process is executed by feeding the material in a quantity $$(Q_{in}=Q_{out}+\Delta Q^+)$$

which is the unit increment ($\Delta Q^+$) greater than each shot weight ($Q_{out}$), and when the quantity of material detained (Q) in the cylinder has reached the upper limit ($Q_{max}$) due to the accumulation of the unit increments ($\Delta Q^+$) the quantity of material fed ($Q_{in}$) is changed to a quantity $$(Q_{in}=Q_{out}-\Delta Q^-)$$

which is the unit decrement ($\Delta Q^-$) less than the shot weight ($Q_{out}$), and in which after the change, the injection process is further executed, and when the quantity of material detained (Q) in the cylinder has reached the control lower limit ($CQ_{min}$) due to the accumulation of the unit decrements ($\Delta Q^-$), the quantity of material fed ($Q_{in}$) is returned to a quantity which is the unit increment ($\Delta Q^+$) greater than the shot weight ($Q_{out}$) so as to increase the quantity of material detained (Q), thereby optimally maintaining the quantity of material detained (Q) in the cylinder.

In accordance with the above-described arrangement, when the quantity of material detained (Q) is between the upper limit ($Q_{max}$) and the control lower limit ($CQ_{min}$), and when the material is fed in a quantity $$(Q_{in}=Q_{out}+\Delta Q^+)$$

which is the unit increment ($\Delta Q^+$) greater than the shot weight for each shot, the quantity of material detained (Q) in the cylinder reaches the upper limit ($Q_{max}$) due to the accumulation of the unit increments ($\Delta Q^+$). Accordingly, the quantity of material fed ($Q_{in}$) is changed to a quantity $$(Q_{in}=Q_{out}-\Delta Q^-)$$

which is the unit decrement ($\Delta Q^-$) less than the shot weight ($Q_{out}$). Accordingly, when the injection process is repeated, the quantity of material detained (Q) in the cylinder reaches the control lower limit ($CQ_{min}$) due to the accumulation of the unit decrements ($\Delta Q^-$). Accordingly, the quantity of material fed ($Q_{in}$) is returned to a quantity which is the unit increment ($\Delta Q^+$) greater than the shot weight ($Q_{out}$) so as to increase the quantity of material detained (Q). As these changes of the quantity of material fed ($Q_{in}$) are automatically repeated, the quantity of material detained (Q) in the cylinder is maintained within the range between the upper limit ($Q_{max}$) and the control lower limit ($CQ_{min}$), thereby making it possible to prevent an abnormality of the rotation of the screw and short shots. It should be noted that, in the invention, the shot weight ($Q_{out}$) is measured automatically by a weight measurement sensor or manually to calculate that the quantity of material detained (Q) has reached the upper limit ($Q_{max}$) and the control lower limit ($CQ_{min}$).

In addition, in the invention, at least one of the rotational load pressure, back pressure, and screw rotating time during the rotation of the screw is used to detect the reaching of the upper limit ($Q_{max}$). As a result, the invention can be implemented by using a detecting means which is conventionally disposed.

In addition, in the invention, in the case where the quantity of material fed is changed, the unit increment ($\Delta Q^+$) and the unit decrement ($\Delta Q^-$) are changed in steps. This is to prevent the molten state of the material in the cylinder from changing suddenly and to prevent the occurrence of an abnormality in the quality.

In addition, in the invention, in a case where changes are made in steps, the unit increment ($\Delta Q^+$) and the unit decrement ($\Delta Q^-$) themselves which are applied in a prescribed time duration are changed, or the applicable prescribed time duration is changed. This facilitates the programming of a control program.

In addition, in the invention, alloy chips of one of Mg, Al, Zn, Sn, Pb, and Bi are used as the molding material. These materials are easily available, and are suitable to the implementation of the invention in the light of their properties.

To sum up the major points of the foregoing description and give a further description, the control method of the injection molding for stabilizing metering without causing a rise in the rotational load pressure is to control the quantity material detained within upper and lower limits by directly or indirectly estimating the quantity of material detained in the cylinder. Namely, the material is fed in a quantity $$(Q_{in}=Q_{out}+\Delta Q^+)$$

which is $\Delta Q^+$ greater than the shot weight $Q_{out}$, and when the quantity of material detained in the cylinder has reached the upper limit $Q_{max}$ due to the accumulation of $\Delta Q^+$, the quantity of material fed $Q_{in}$ is changed to a quantity $$(=Q_{out}-\Delta Q^-)$$

which is $\Delta Q^-$ less than the shot weight $Q_{out}$, so as to decrease the quantity of material detained in the cylinder. On the other hand, in a case where the quantity of material detained is on a decreasing trend, at the point of time when the quantity of material detained has reached the control lower limit $CQ_{min}$ which is set at a level lower than the lower limit $Q_{min}$ of the quantity of material detained which was determined experimentally, the quantity of material fed $Q_{in}$ is changed again to a value which is $\Delta Q^+$ greater than the shot weight $Q_{out}$ so as to increase the quantity of material detained. Thus, stable metering is realized by effecting molding while repeating the decrease and increase of the quantity of material detained in the cylinder within the range between the upper and lower limits.

DETAILED DESCRIPTION OF PREFERRED EMBODIMENTS

Figure 1:
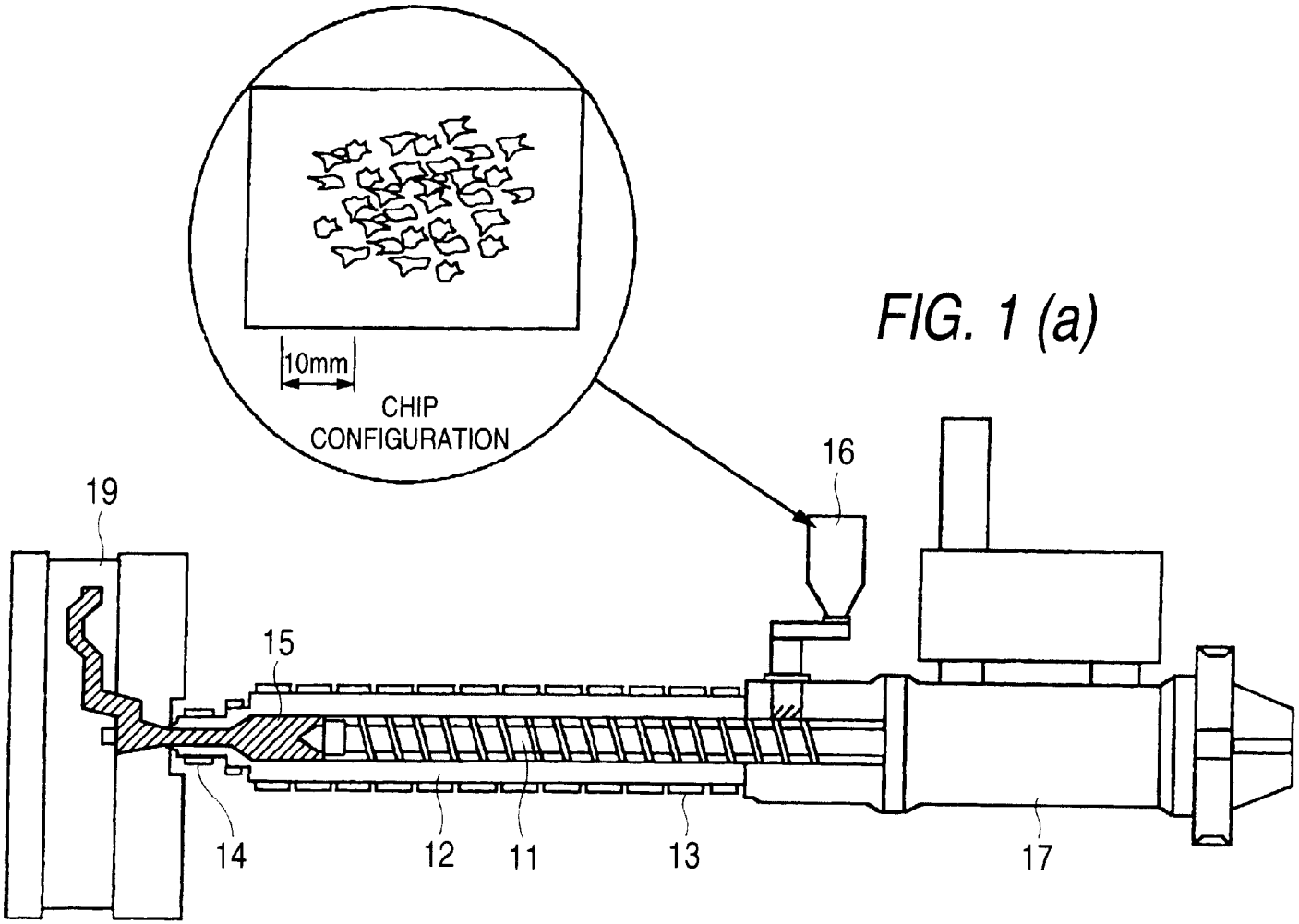
FIG. 1A is a schematic diagram illustrating a low-melting-point alloy injection molding machine.
FIG. 1B is a diagram explaining the material in chip form used for the low-melting-point alloy injection molding machine shown in FIG. 1A.
Figure 2:
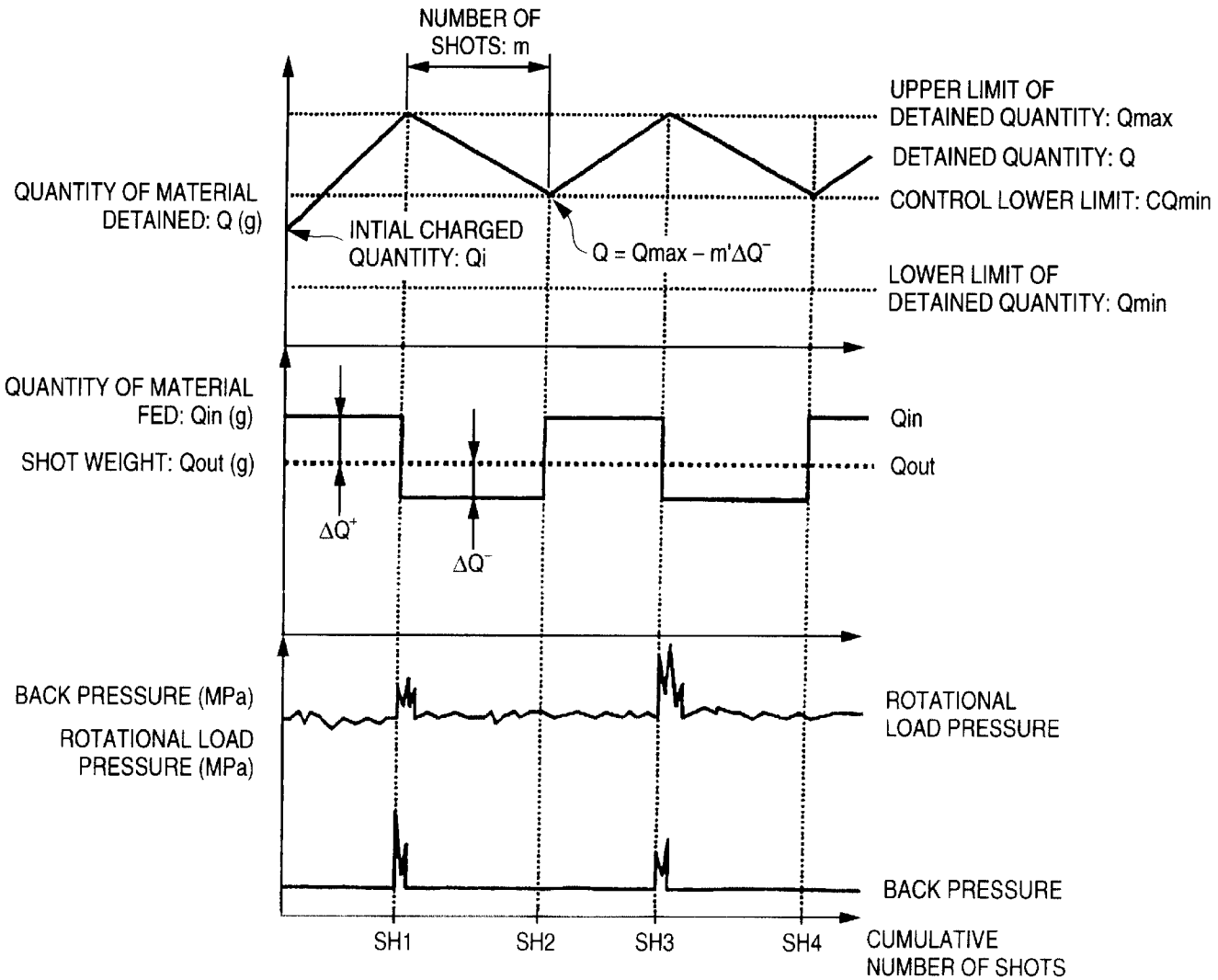
FIGS. 2(*a*) to (*c*) are time chart illustrating changes in the quantity of material detained, the quantity of material fed, the shot weight, and the back pressure and rotational load pressure during the rotation of a screw with respect to the number of shots in a case where the control method of the injection molding in accordance with the invention is applied to the low-melting-point alloy injection molding machine shown in FIG. 1A.
Figure 3:
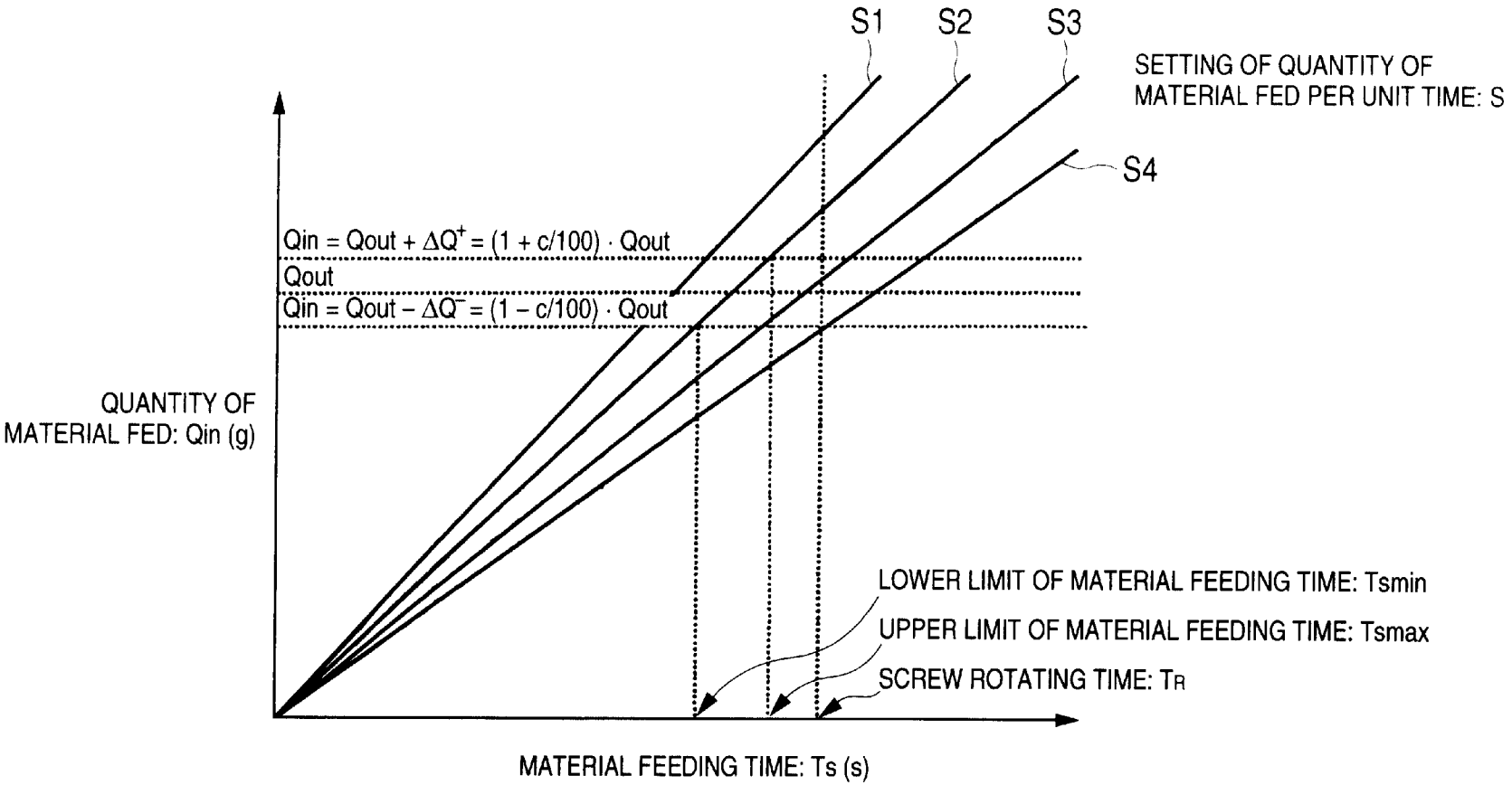
FIG. 3 is a graph explaining the relationship between the material feeding time of and the quantity of material fed from a material feeder.
Figure 4:
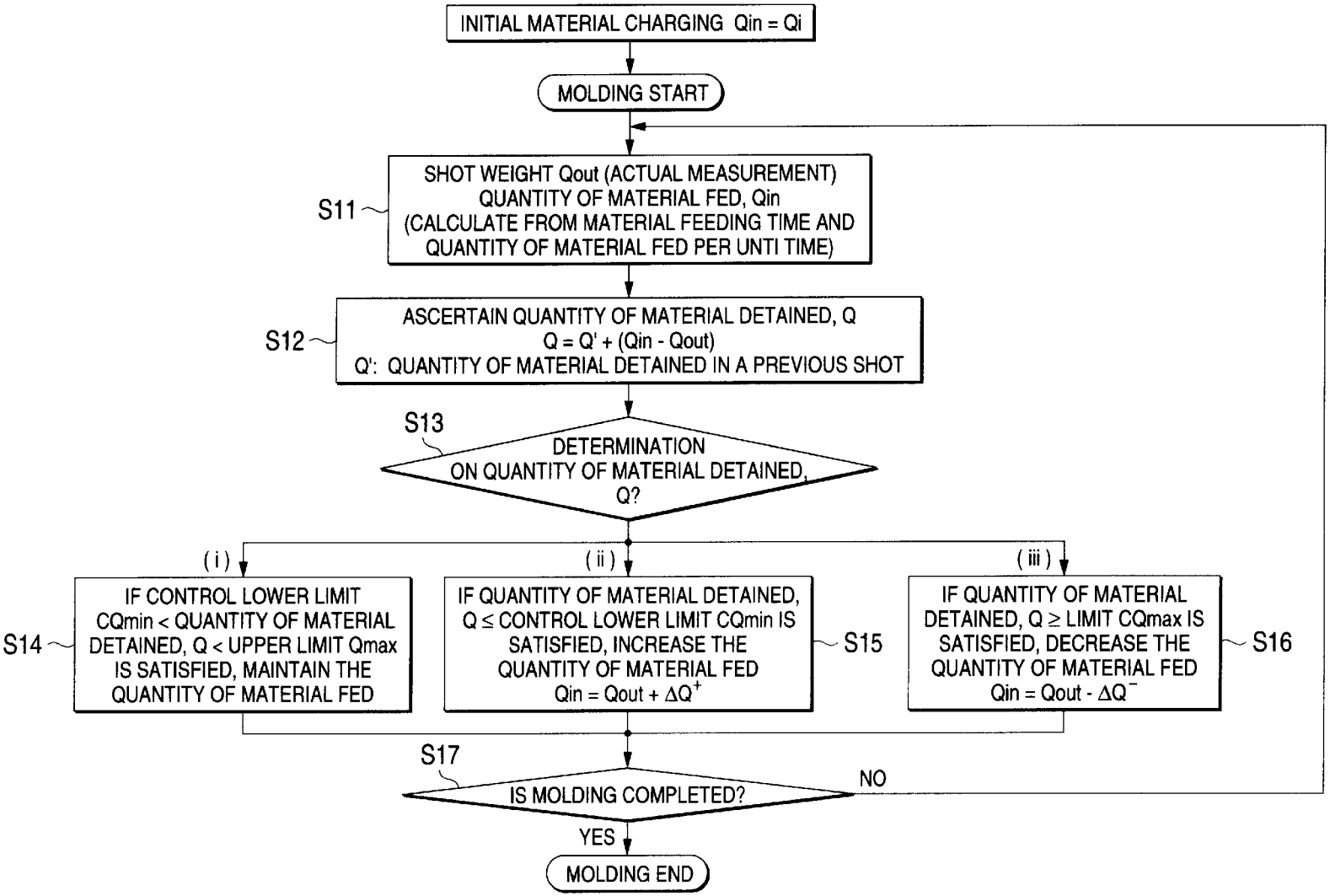
FIG. 4 is a flowchart explaining an example of control operation in accordance with the invention.
Figure 5:
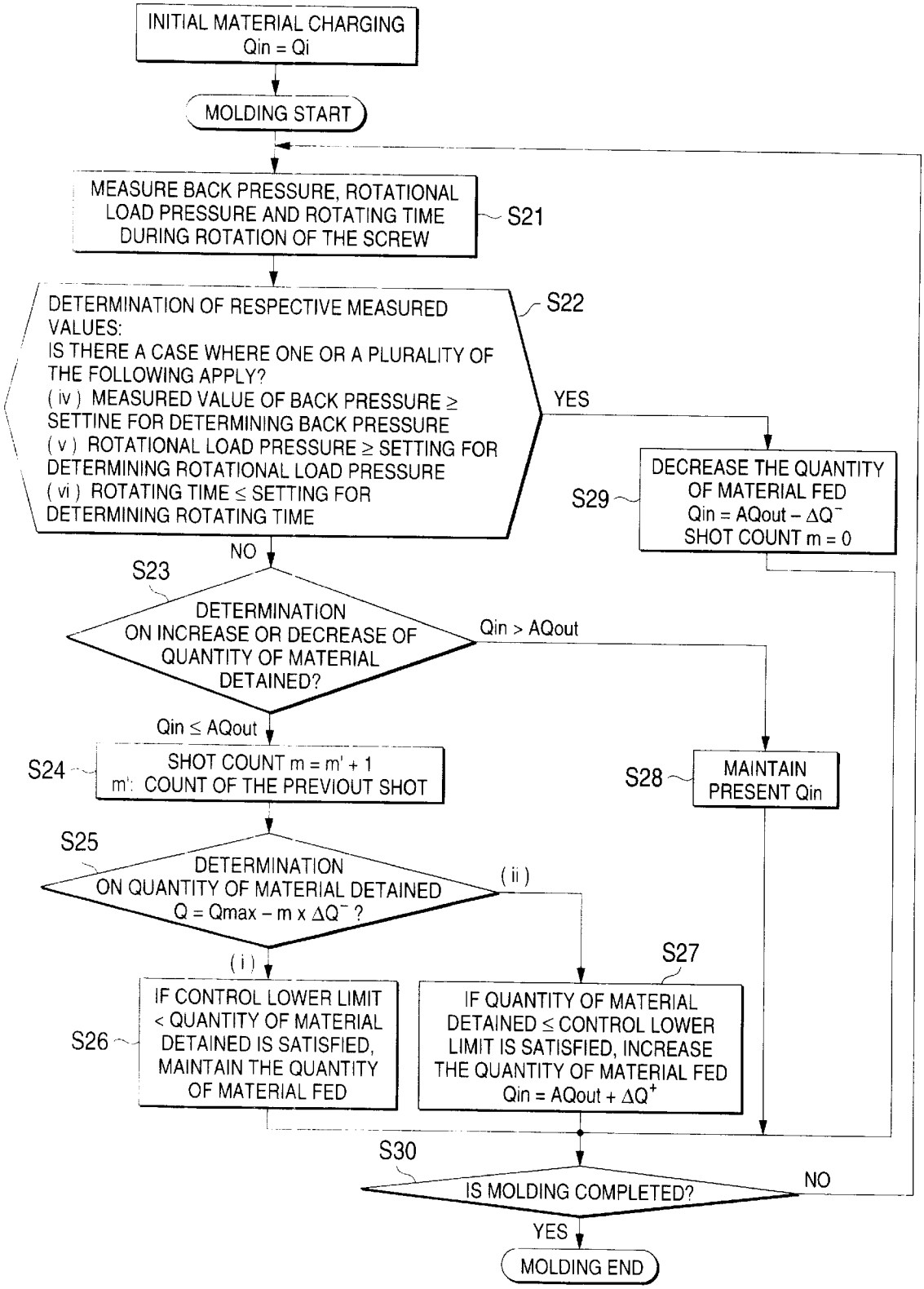
FIG. 5 is a flowchart explaining another example of the control operation in accordance with the invention.

Referring now to the accompanying drawings, a description will be given of an embodiment of the invention. FIGS. 2(*a*) to (*c*) are time charts illustrating changes in the quantity of material detained, the quantity of material fed, the shot weight, and the back pressure and rotational load pressure during the rotation of a screw with respect to the number of shots in a case where the control method of the injection molding in accordance with the invention is applied to a low-melting-point alloy injection molding machine shown in FIG. 1*a*. FIG. 3 is a graph explaining the relationship between the material feeding time of and the quantity of material fed from a material feeder. FIG. 4 is a flowchart explaining an example of control operation in accordance with the invention. FIG. 5 is a flowchart explaining another example of the control operation in accordance with the invention.

In the time chart shown in FIGS. 2(*a*) to (*c*), the abscissa represents the cumulative number of shots (SH1, SH2, . . . ) instead of the time. In a case where the operation of the molding machine is started in a state in which the material is absent in a cylinder 12, the material is charged in an arbitrary quantity Qi falling in a range between a lower limit $Q_{min}$ and an upper limit $Q_{max}$ of a quantity of material detained, Q, so as to prevent the occurrence of a short shot (initial material charging).

The lower limit $Q_{min}$ and the upper limit $Q_{max}$ of the quantity of material detained, Q, need to be experimentally determined in advance. As for the method of determining the upper limit $Q_{max}$ of the quantity of material detained, Q, molding is effected while feeding the material in a quantity $$(Q_{in}=Q_{out}+Q^{+})$$

which is $Q^{+}$ greater than the shot weight $Q_{out}$, and the quantity of material detained, Q, is calculated by the following formula while measuring the shot weight $Q_{out}$, the rotational load pressure, back pressure, and the screw rotating time at that time:

$$Q=Q'+Q_{in}-Q_{out} \tag{1}$$

Q'=quantity of material detained in a previous shot

The quantity of material detained, Q, at the point of time when increases in the rotational load pressure and back pressure or the shortening of the screw rotating time has been confirmed is set as the upper limit $Q_{max}$. Further, after the observation of the upper limit $Q_{max}$, the quantity of material fed is changed to a quantity $$(Q_{in}=Q_{out}-\Delta Q')$$

which is $\Delta Q'$ less than the shot weight $Q_{out}$, and molding is continued. Then, the quantity of material detained, Q, at the point of time when a short shot has occurred is set as the lower limit $Q_{min}$, and a value close to an intermediate value between $Q_{max}$ and $Q_{min}$ is set as a control lower limit $CQ_{min}$. The average value (excluding the short shot) of the measured shot weight, $AQ_{out}$, during this molding operation is calculated.

It should be noted that, at the time of the initial material charging, a screw 11 is caused to effect only the rotating motion at a most advanced position, and the material is fed by continuous operation or intermittent operation in two to five charges while the material is being fed from a material feeder 16 until the quantity of material detained, Q, reaches the predetermined quantity Qi.

In the metering operation which is effected after the initial material charging, the screw 11 is retracted by being rotated at a fixed speed up to a predetermined stroke commensurate to the shot weight $Q_{out}$ while the screw 11 is being rotated. During the metering operation, the material in a quantity $$(Q_{in}=Q_{out}+\Delta Q^{+})$$

which is a unit increment $\Delta Q^{+}$ greater than the estimated shot weight $Q_{out}$ is fed in the form of being interlocked with the start and the end of screw rotation, or uniformly in a material feeding time $t_s$ set shorter than the screw rotating time. In the case where molding is effected while feeding the material in the quantity of material fed, $Q_{in}$, which is $\Delta Q^{+}$ greater than the shot weight $Q_{out}$, the quantity of material detained, Q, in the cylinder 12 increases linearly, and reaches the upper limit $Q_{max}$ when the number of shots SH1, for instance, is reached.

In the above-described case, to determine whether or not the upper limit $Q_{max}$ has been reached, there are the following two methods: Namely, (a) the shot weight $Q_{out}$ is measured for each shot, the difference $$(\Delta Q^{+}=Q_{in}-Q_{out})$$

between the shot weight $Q_{out}$ and the quantity of material fed, $Q_{in}$, is accumulated, and the quantity of material detained, Q, is directly ascertained, or (b) when the quantity of material detained, Q, reaches the upper limit $Q_{max}$, the back pressure and the rotational load pressure during the rotation of the screw increase as shown in FIG. 2, or the screw rotating time becomes short, so that the quantity of material detained, Q, is indirectly ascertained by determining their change.

In the case where it is detected by the above-described method (a) or (b) that the quantity of material detained, Q, has reached the upper limit $Q_{max}$, the quantity of material fed, $Q_{in}$, is changed to a quantity which is $\Delta Q^-$ less than the shot weight $Q_{out}$. As molding is effected while feeding the material under the condition in which the quantity of material fed, $Q_{in}$, is $\Delta Q^-$ less than the shot weight $Q_{out}$, the quantity of material detained, Q, in the cylinder 12 increases linearly (e.g., the number of shots: SH1 to SH2). In this case, to ensure that the quantity of material detained, Q, does not become less than the lower limit $Q_{min}$, the quantity of material detained, Q, is estimated by one of two methods which are described below. Namely, (c) the shot weight $Q_{out}$ is measured for each shot, the difference $$(\Delta Q^- = Q_{in} - Q_{out})$$

between the shot weight $Q_{out}$ and the quantity of material fed, $Q_{in}$, is accumulated, and the quantity of material detained, Q, is directly ascertained, or (d) by using the number of shots m $$(m = SH2 - SH1)$$

after the change of the quantity of material fed, $Q_{in}$, and a decrement $\Delta Q^-$ of the detained quantity for each shot, the quantity of material detained, $$Q = Q_{max} - m \cdot \Delta Q^-,$$

is estimated.

At the point of time when the quantity of material detained, Q, estimated by the above-described method (c) or (d) has reached the control lower limit $CQ_{min}$, the quantity of material fed, $Q_{in}$, is changed again to a quantity which is $\Delta Q^+$ greater than the shot weight $Q_{out}$. It should be noted that in the case where the quantity of material fed, $Q_{in}$, is increased, the quantity of material fed, $Q_{in}$, may be increased in steps to ensure that the molten state of the material in the cylinder does not change abruptly. Here, the quantity of material fed, $Q_{in}$, is determined by taking into account the variation of the quantity of material fed from the material feeder. Namely, in the quantity of material fed, a variation of ±1 to ±5% is inherently present due to the particle size distribution, particle size, and the like of the material.

In the case where the variation of the quantity of material fed is set to ±c % by taking the above-described facts into consideration, the quantity of material fed, $Q_{in}$, is changed by adjusting the material feeding time $t_s$ in view of the relationship between the material feeding time $t_s$ and the quantity of material fed, $Q_{in}$, shown in FIG. 3 in accordance with the following formulae. Namely, In the case where the quantity of material detained is increased:

$$t_{smax} \leqq t_s \leqq t_R \tag{2}$$

where $$t_{smax} = (1 + c/100) \cdot Q_{out}/S$$

In the case where the quantity of material detained is decreased:

$$t_s \leqq t_{smin} \tag{3}$$

where $$t_{min} = (1 - c/100) \cdot Q_{out}/S$$

Here, $t_R$ is the screw rotating time, and S is the quantity of material fed per unit time in which the material feeding time $t_s$ satisfies the above-described relationship.

In the case where the above-described adjustment is effected, in practice, the quantity of material fed is automatically adjusted by directly or indirectly estimating the quantity of material detained through such as the combination of the methods (a) and (c) above or the combination of the methods (b) and (d) above, and by feeding back the result to a control system of the molding machine. If the quantity of material detained is thus controlled within the range between the upper and lower limits while repeating the increase and decrease of the quantity of material fed, it is possible to realize stable metering which is free of such as an increase in the rotational load pressure of the screw.

Referring to FIG. 4, a description will be given of the controlling operation based on the combination of the methods (a) and (c) as the above-described example. first, after effecting injection, the shot weight $Q_{out}$ of that shot is measured, and the quantity of material fed, $Q_{in}$, is calculated from the material feeding time and the quantity of material fed per unit time (Step S11). The difference $$(\Delta Q^+ = Q_{in} - Q_{out})$$

between the shot weight $Q_{out}$ and the quantity of material fed, $Q_{in}$, is calculated, and this difference is added to the quantity of material detained (Q') during the previous shot $$(Q = Q' + Q_{out})$$

so as to determine the quantity of material detained, Q, (Step S12). Here, the measurement of the shot weight $Q_{out}$ can be effected automatically by attaching a weight measurement sensor to an ejector for ejecting the molded articles.

Then, a determination is made as to which of the following formulae (i), (ii), and (iii) the quantity of material detained, Q, thus obtained satisfies (Step S13):

(i) control lower limit $CQ_{min}$<quantity of material detained, Q<upper limit $Q_{max}$ (ii) quantity of material detained, Q≦control lower limit $CQ_{min}$ (iii) quantity of material detained, Q≧upper limit $CQ_{max}$ If it is determined that the formula (i) is satisfied as a result of the determination in Step S13, the present material feeding operation (the present operation in which the quantity of material detained, Q, is changed by a unit increment ($\Delta Q^+$) or a unit decrement ($\Delta Q^-$) for each shot) is maintained, and the operation proceeds to Step S17 (Step S14). If it is determined that the formula (ii) is satisfied as a result of the determination in Step S13, even in the case where the quantity of material fed was being changed by the unit decrement ($\Delta Q^-$) up until then, the operation is changed over to the operation of $$Q_{in} = Q_{out} + \Delta Q^+$$

for changing the quantity of material fed by the unit increment ($\Delta Q^+$), and the operation then proceeds to Step S17 (Step S15). If it is determined that the formula (iii) is satisfied as a result of the determination in Step S13, the operation is changed over to the operation of $$Q_{in} = Q_{out} - \Delta Q^-$$

in which the quantity of material fed, which was being changed by the unit increment ($\Delta Q^+$) up until then, is changed by the unit decrement ($\Delta Q^-$), and the operation then proceeds to Step S17 (Step S16). In Step 17, a determination is made as to whether or not the injection molding operation has been completed, and if not, the operation returns to Step S11 to continue the operation on the basis of the operation decided in Steps S14, S15, and S16, respectively.

Figure 8:
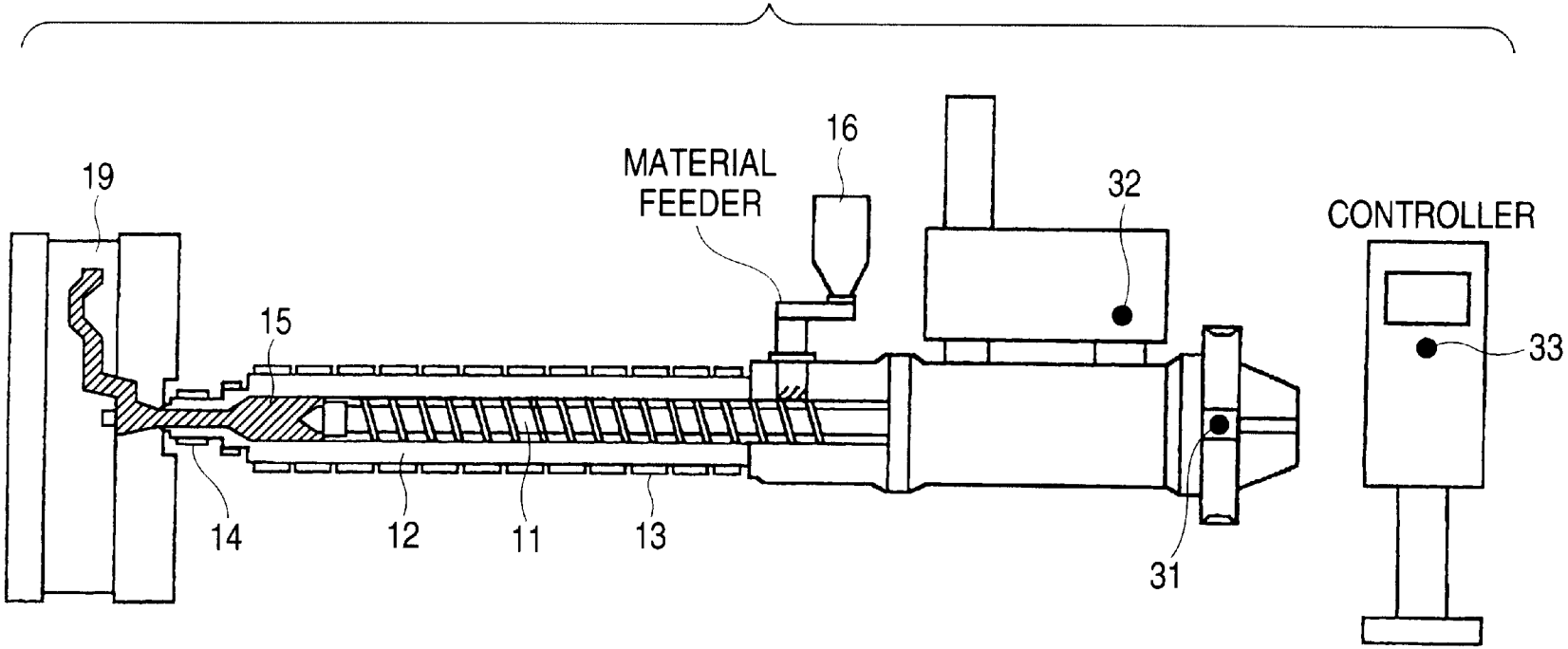
FIG. 8 is a diagram illustrating positions for detecting the back pressure, the rotational load pressure, and the rotating time.

Referring to FIGS. 5 and 8, a description will be given of the control operation through the combination of the methods (b) and (d) as the other example mentioned above. In this method, the fact that the quantity of material detained, Q, has reached the upper limit $Q_{max}$ is detected by the increase of the rotational load pressure and the back pressure or the shortening of the screw rotating time, and the setting of the upper limit $Q_{max}$ is not required. In addition, as the shot weight $Q_{out}$, the weight which is calculated from the mold configuration or the average shot weight $AQ_{out}$ which was experimentally determined in advance is used, and it is unnecessary to measure the shot weight for each shot. It should be noted that, in FIG. 8, reference numeral 31 denotes a position for measuring the rotational load pressure, 32 denotes a position for measuring back pressure, and 33 denotes a position for measuring the screw rotating time. When the injection operation is enabled and normal injection operation is started, the back pressure, rotational load pressure, and rotating time during the rotation of the screw are measured (Step S21). Comparisons are made between, on the one hand, respective settings for determination which have been set as thresholds for the back pressure, rotational load pressure, and rotating time for determining whether or not they are abnormal and, on the other hand, the results of measurement in Step S21, and a determination is made as to whether or not the following conditions (iv), (v), and (vi) have occurred (Step S22):

(iv) measured value of back pressure≧setting for determining back pressure (v) rotational load pressure≧setting for determining rotational load pressure (vi) rotating time≦setting for determining rotating time As a result of the determination in Step S22, in a case where at least one of the conditions (iv), (v), and (vi) has occurred, the material feeding time is decreased to allow the material feeding operation to execute the operation of $$Q_{in}=AQ_{out}-\Delta Q^{-},$$

and the shot count m is concurrently set to m=0 (Step S29). If it is determined that none of the conditions (iv), (v), and (vi) has occurred as a result of the determination in Step S22, a determination is made for increasing or decreasing the quantity of material detained with respect to the present quantity of material fed (Step S23). In Step S23, if the quantity of material detained is in an increasing process, i.e., $Q_{in}>A\,Q_{out}$, the operation proceeds to Step S28 to maintain the present $Q_{in}$, and in this situation the operation proceeds to Step S30. On the other hand, if in Step S23 the quantity of material detained is in an decreasing process, i.e., $Q_{in}\leqq AQ_{out}$, the shot count m is set to m=m'+1 (m' is the count of the previous shot) in Step S24, and the operation then proceeds to Step S25 to determine the quantity of material detained in accordance with $$Q=Q_{max}-m\Delta Q^{-}.$$

Namely, a determination is made as to which of the following formulae (i) and (ii) the quantity of material detained, Q, thus obtained satisfies (Step S25):

(i) control lower limit $CQ_{min}$<quantity of material detained, Q (ii) quantity of material detained, Q≦control lower limit $CQ_{min}$ If it is determined that the formula (i) is satisfied as a result of the determination in Step S25, the present material feeding operation (the present operation in which the quantity of material detained, Q, is changed by the unit decrement ($\Delta Q^{-}$) for each shot) is maintained, and the operation proceeds to Step S30 (Step S26). If it is determined that the formula (ii) is satisfied as a result of the determination in Step S25, even in the case where the quantity of material fed was being changed so as to be the unit decrement ($\Delta Q^{-}$) less than the shot weight $Q_{out}$ up until then, the operation is changed over to the operation of $$Q_{in}=Q_{out}+\Delta Q^{+}$$

in which the quantity of material fed is changed to increase by the unit increment ($\Delta Q^{+}$), and the operation then proceeds to Step S30 (Step S27). In Step 30, a determination is made as to whether or not the injection molding operation has been completed, and if not, the operation returns to Step S21 to continue the operation on the basis of the operation decided in Steps S26, S27, S28 and S29, respectively.

Figure 6:
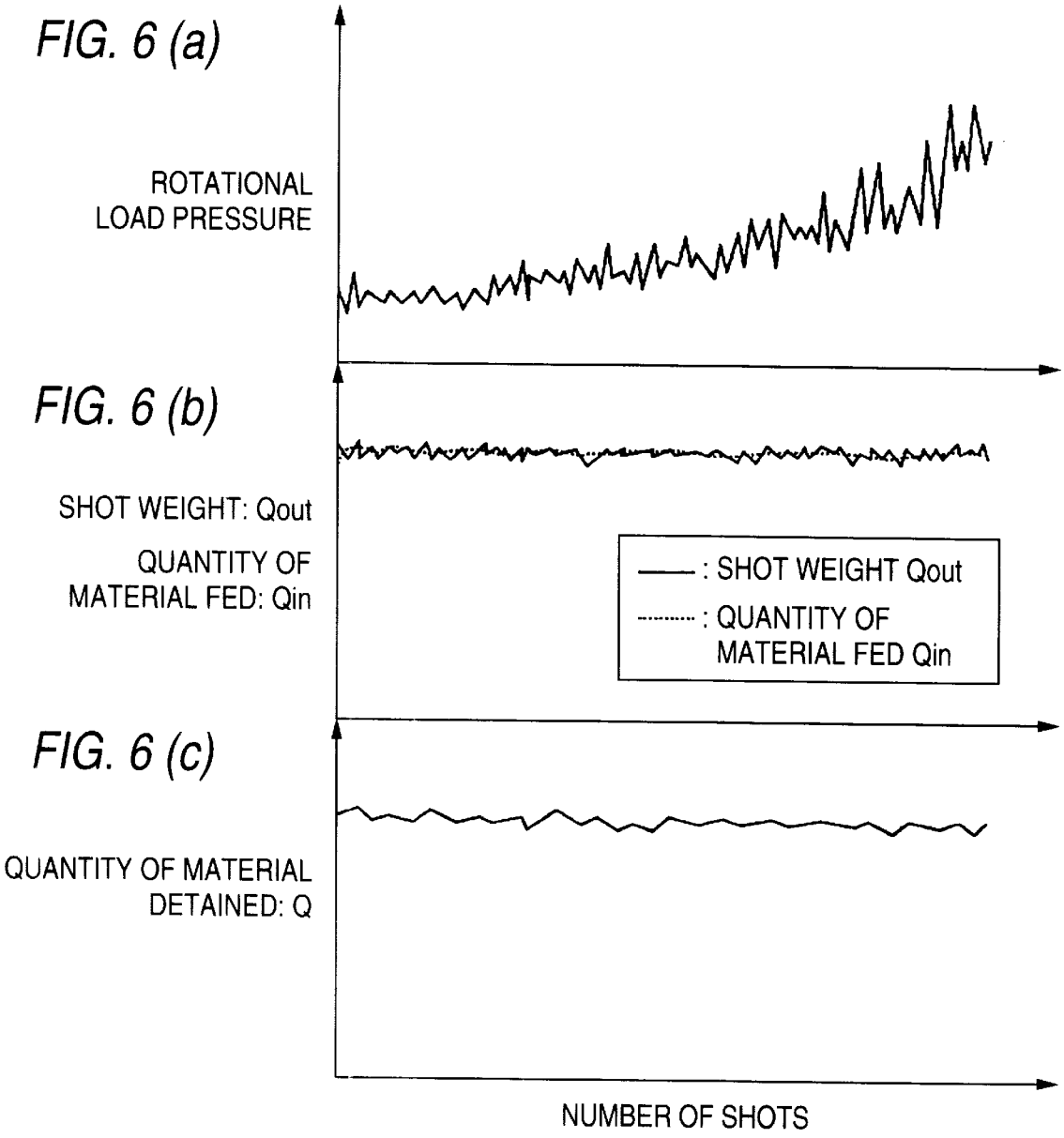
FIGS. 6(*a*) to (*c*) are flowcharts explaining changes in the rotational load pressure, the shot weight, the quantity of material fed, and the quantity of material detained in accordance with a conventional method in an example for comparison.
Figure 7:
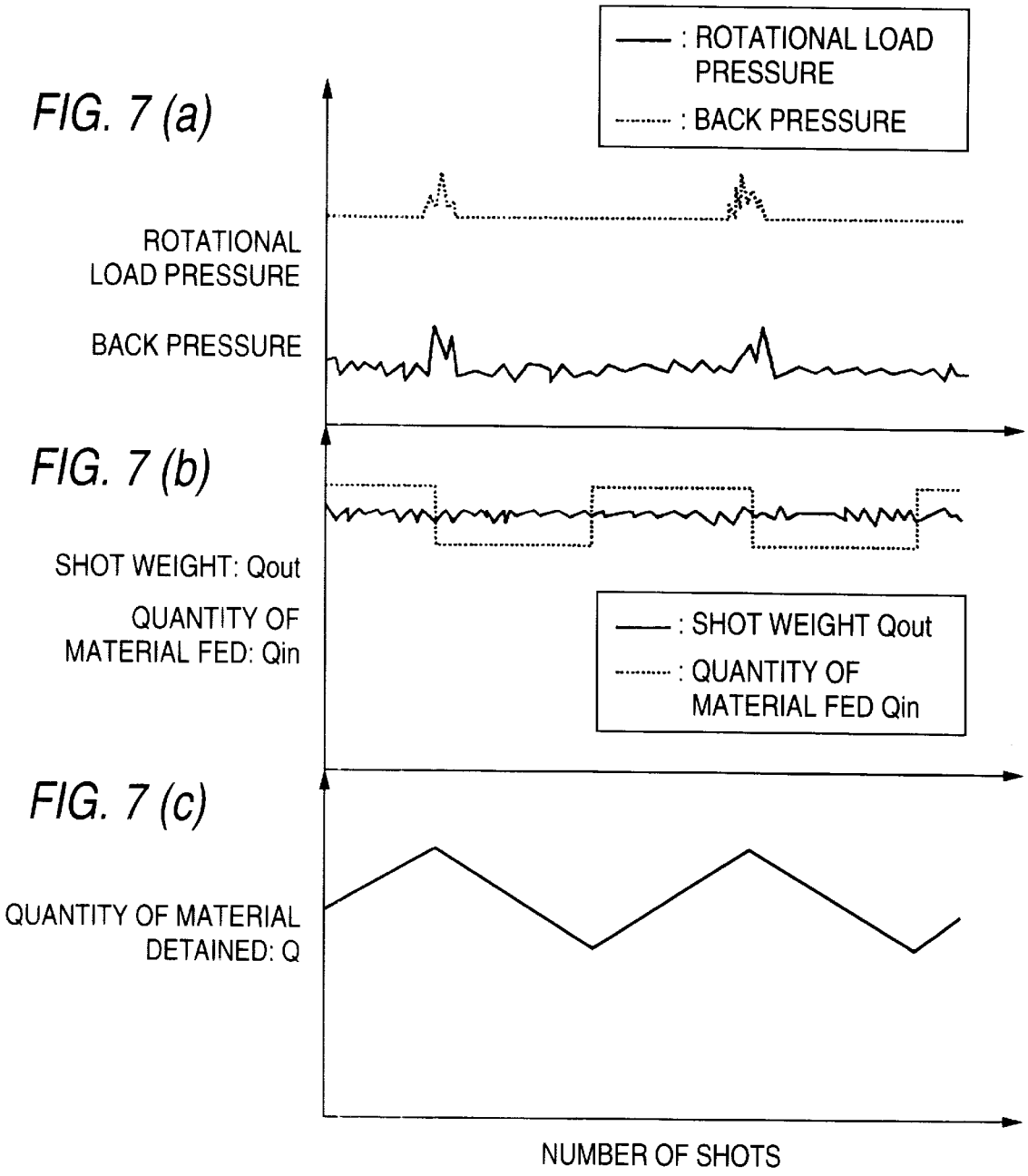
FIGS. 7(*a*) to (*c*) are flowcharts explaining changes in the rotational load pressure, the back pressure, the shot weight, the quantity of material fed, and the quantity of material detained in accordance with the invention in an example for comparison.

Referring next to FIGS. 6(*a*) to (*c*) and 7(*a*) to (*c*), a description will be given of examples for comparison between a case where a conventional method is used and a case where the method of the invention is used when molding is effected by using the same mold. When notebook-sized personal computer housings of an Mg alloy (AZ91D) having a shot weight of about 300 g were molded in the conventional manner while adjusting the quantity of material fed such that the quantity of material detained would become fixed, a tendency was noted in which the rotational load pressure of the screw rose when molding was effected for a number of hours (FIG. 6). In contrast, when molding was effected by using the same mold while controlling the quantity of material fed by setting such that $\Delta Q^{+}$=25 g and $\Delta Q^{-}$=20 g so that the quantity of material detained would fall within the range between the upper and lower limits, even if continuous molding was effected for about 12 hours, the rotational load pressure of the screw could be maintained at a fixed low level, and approximately 800 shots could be molded with a standard deviation of 0.91 in the shot weight (FIGS. 7(*a*) to (*c*)).

It should be noted that the upper limit of the quantity of material detained which was experimentally determined in advance in this case was approximately 6000 g, and the lower limit was approximately 2500 g. In addition, control of the quantity of material detained was executed while adjusting the feeding of the material in accordance with the above-described methods (b) and (d). The thresholds at that time (the reaching of the upper limit was detected by adopting the back pressure, and the control lower limit was estimated from the number of shots and the quantities of material fed) were as follows:

Condition for the Reaching of the Upper Limit:

Back pressure=0.3 MPa

Conditions for the Reaching of the Control Lower Limit

No. of shots n=100

Decrement of the quantity of material detained, $\Delta Q^{-}$=20 g

Control lower limit $$CQ_{min}=Q_{max}-n\cdot\Delta Q^{-}$$

$$=6000-100\times20=4000\ (g)$$

Since the control method of injection molding in accordance with the invention is arranged as described above, the following advantages are offered. Concerning the problem of instability of metering in the low-melting-point alloy injection molding machine, as the quantity of material detained in the cylinder, which constitutes one cause thereof, is controlled by directly or indirectly estimating it, it is possible to overcome the problem of instability of metering, including an abnormal rise of the rotational load pressure of the screw and the impossibility of rotation of the screw. Further, by ascertaining the quantity of material detained by a method of estimating it by measuring the shot weight for each shot or by a method of estimating it on the basis of a change of the back pressure, rotational load pressure, and rotating time during the rotation of the screw, it becomes possible to provide feedback to the control system of molding machine, and it becomes possible to automate the adjustment of conditions which has been carried out experientially by the operator. In consequence, it becomes possible to reduce the down time caused by the instability of metering in the molding machine, and manpower for adjustment of the conditions is not required, thereby making it possible to curtail the cost.

What is claimed is:

1. A control method of an injection molding in which a low-melting-point alloy, which is a molding material, is melted in a cylinder of a screw-type low-melting-point alloy injection molding machine and is injected into a mold by a screw to effect molding, and control is provided such that an appropriate quantity of material is fed from a material feeder in correspondence with a shot and the quantity of material detained in said cylinder is maintained appropriately, comprising the steps of:

setting a unit increment and a unit decrement as well as an upper limit and a control lower limit of a quantity of material detained; and automatically repeating the operation in which an injection process is executed by feeding the material in a quantity which is the unit increment greater than each shot weight, and when the quantity of material detained in said cylinder has reached the upper limit due to the accumulation of the unit increments, the quantity of material fed is changed to a quantity which is the unit decrement less than the shot weight, and in which after the changing, when the quantity of material detained in said cylinder has reached the control lower limit due to the accumulation of the unit decrements, the quantity of material fed is returned to a quantity which is the unit increment greater than the shot weight so as to increase the quantity of material detained, thereby optimally maintaining the quantity of material detained in the cylinder.

2. The control method of the injection molding according to claim 1, wherein the shot weight is measured automatically by a weight measurement sensor or manually to calculate that the quantity of material detained has reached the upper limit and the control lower limit.

3. The control method of the injection molding according to claim 1, wherein at least one of the rotational load pressure, back pressure, and screw rotating time during the rotation of said screw is used to detect the reaching of the upper limit.

4. The control method of the injection molding according to claim 1, wherein when quantity of material fed is changed, the unit increment and the unit decrement are changed in steps.

5. The control method of injection molding according to claim 4, where when the changes are made in steps, the unit increment and the unit decrement themselves which are applied in a prescribed time duration are changed, or the applicable prescribed time duration is changed.

6. The control method of the injection molding according to claim 1, wherein alloy chips is selected from a group consisting of Mg, Al, Zn, Sn, Pb, and Bi.

* * * * *